United States Patent [19]

Terrell et al.

[11] 4,232,634

[45] Nov. 11, 1980

[54] HIGH EFFICIENCY HOT WATER BOILER

[75] Inventors: George C. Terrell, Foxboro; Andrew Konnerth, III, Swansea, both of Mass.

[73] Assignee: Conservation Technologies, Inc., Bristol, R.I.

[21] Appl. No.: 952,549

[22] Filed: Oct. 16, 1978

[51] Int. Cl.[3] ..... F22B 27/00

[52] U.S. Cl. ..... 122/41; 122/279; 122/208; 122/359; 122/136 R

[58] Field of Search ..... 122/41, 279, 282, 136 R, 122/149, 135 F, 208, 214, 216, 210, DIG. 3, 359

[56] References Cited

U.S. PATENT DOCUMENTS

| | | | |
|---|---|---|---|
| 1,077,761 | 11/1913 | Schneider | 122/208 |
| 1,226,849 | 5/1917 | Bookman | 122/208 |
| 1,359,888 | 11/1920 | Greene | 122/359 |
| 1,383,408 | 7/1921 | Leister | 122/208 |
| 2,197,603 | 4/1940 | Allen | 122/279 |
| 2,756,727 | 7/1956 | Caplan | 122/359 |
| 4,026,246 | 5/1977 | Colle et al. | 122/210 |

*Primary Examiner*—Henry C. Yuen

*Attorney, Agent, or Firm*—Salter & Michaelson

[57] ABSTRACT

Apparatus and method for high efficiency transfer of heat from a combustion process to a working fluid wherein the combustion flame directly impinges upon a special material in contact with conduit means for directing the flow of the working fluid. The hottest part of the flame may be adjusted to directly contact such material. The apparatus in which such process takes place is subjected to a pressure gradient, directed from the top to the bottom of said apparatus such that the combustion gases are downwardly directed through the device for secondary heating of said working fluid prior to exhaust therefrom.

21 Claims, 4 Drawing Figures

FIG. 1
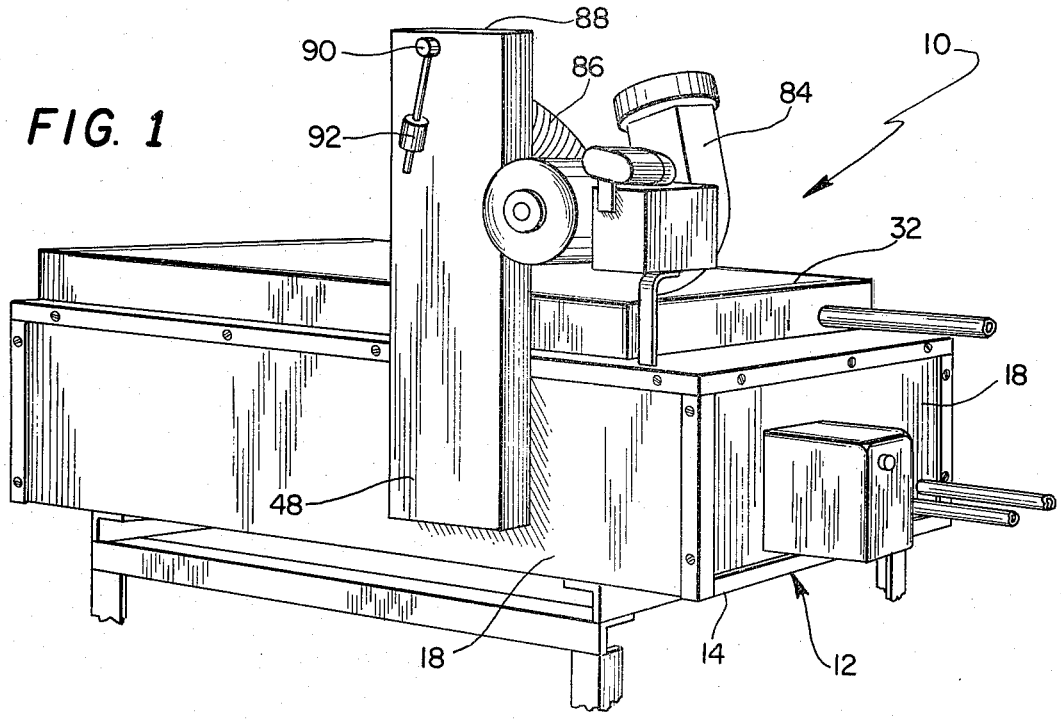
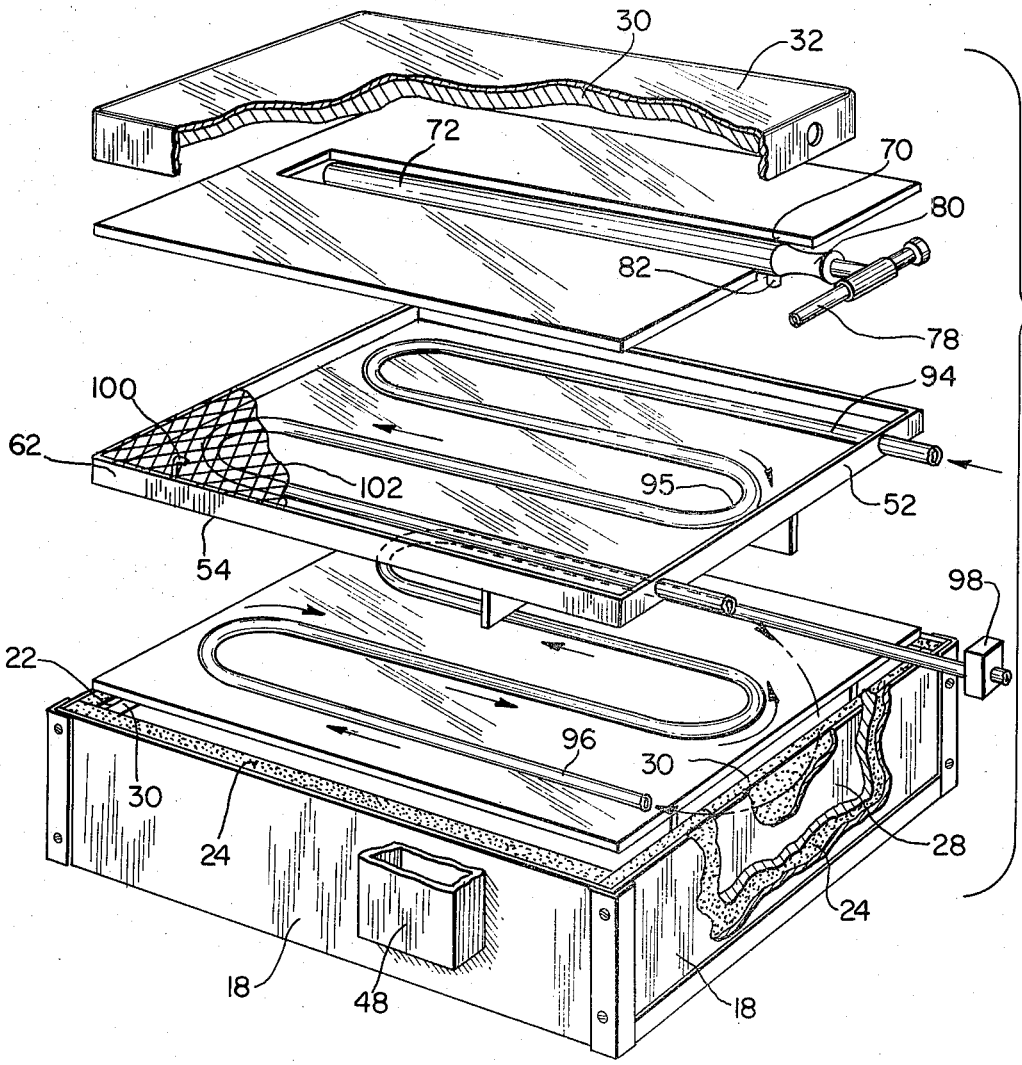
FIG. 2

HIGH EFFICIENCY HOT WATER BOILER

BACKGROUND AND SUMMARY OF THE INVENTION

This invention relates to a heat exchange device and more specifically to a furnace, boiler or the like which transfers heat from a burning fuel to a working fluid contained within a conduit. The working fluid may be air, water, oil, brine or any other suitable similar fluid. Accordingly, the invention has utility as the furnace or hot water supply of a home but is not so limited, having application for a wide variety of heat exchange applications.

Known heating devices of this nature normally include a combustion chamber around or through which conduits pass such that working fluid may be directed through the conduit so as to absorb heat from the combustion chamber or the walls thereof. Inasmuch as heat passes through the walls of such conduits in proportion to the temperature gradient thereacross, it would be desirable to establish a maximum temperature at the conduit surface adjacent the combustion chamber so that heat may be most rapidly transferred to the working fluid. Normally, the heat exchange conduits in furnaces or boilers of this type comprise metal chambers, tubes and the like which if subjected to constant high heat in the presence of oxygen and products of fuel combustion would rapidly burn up and degrade, especially if contacted by that portion of the flame known to produce the highest temperature point therein, i.e. at the tip of inner reducing cone of the flame. It has been found that when burning gaseous hydrocarbon fuels such as natural gas, this temperature reaches approximately 2400° F. At such high temperatures, rapid oxidation of the heat exchange conduits would occur and this has detered the use of otherwise maximum temperature gradients which would result in maximum heat transfer rates at such conduit surfaces. Accordingly, direct flame contact with such conduit surfaces is avoided, except in industrial applications where very expensive corrosion resistant alloys such as Inconel or Hastalloy can be used.

An additional phenomena which has restricted the use of direct flame impingement upon working fluid conduits in heat exchange units of this type is that the presence of the much cooler working fluid within the conduit tends to reduce the temperature of the flame such that the gases in the region of the highest temperature point of the flame need additional residence time for the combustion process to be completed. In other words, the continual movement of the working fluid through the conduit tends to quench and accordingly slow down the combustion reaction.

A common constructional feature of prior art heaters is that they are operated by natural convection, that is, the buoyancy of the heated combustion gases cause them to rise which in turn enables fresh combustion air to be drawn into the flame region to sustain burning. Also, precise control of the volume of combustion air utilized is thus not available. Generally, systems of this type are operated intermittently, that is, gases are burned upon signal, effective as when the working fluid drops below a predetermined temperature level and shut off when the temperature thereof reaches a desired level. Accordingly, when fuel is not being burned, natural convection will draw heated air from the combustion chamber and adjacent heat sinks upwardly through the exhaust stack to the atmosphere. This loss of heat from the walls of the combustion chamber and other parts of the equipment during the off cycles of such devices, reduces overall system efficiency.

It is accordingly an object of the present invention to present a device of such construction that it may be operated so as to take advantage of maximum feasible temperature gradients in order to achieve a high heat transfer rate while avoiding the aforementioned prior art drawbacks. This and other objects of the present invention are accomplished by the use of a device comprising a housing having at least a first exchange manifold which forms the lower part of a combustion chamber disposed directly thereabove. The top surface of the manifold includes or supports a working fluid conduit. A flow pattern is established in the combustion chamber by the physical relationship of the burner relative to the point of maximum negative pressure, such that the flow of hot combustion gases is tangential to the working fluid conduits. This tangential flow enables a physically optimal relationship to be established between the working fluid conduits and the flowing gas stream, such that a maximum heat transfer rate is established without direct impingement of the hottest portion of the flame on the metal surface. This optimal relationship depends upon physically structuring the surface which is being brought into contact with the tangential stream of flowing hot combustion gases and locating the surface relative to said stream at such a point that maximum turbulence is established. It is found that, by means of such a device, the tendency of the cool surface of the working fluid conduits to quench the combustion process is avoided completely. The application of the device is, however, limited to the use of 300 series stainless steels or any more corrosion resistant alloy for the material of construction of the working fluid conduits, or to the use of the steel surface, which has been treated with a thin film of ceramic material or a fused metal oxide film of such material as will not be fused or vaporized at temperatures of 2600° F. or below. Alumina is an example of such a material. Also, in some cases, the object could be achieved by the construction of the conduit from highly corrosion and heat resistant materials, e.g., inconel (a trademark of International Nickel), and hasteloy (a trademark of Haynes Stellite Co.), which are high chromium-nickel alloys. In any event, the physical geometry described above enables a flame resulting from the burning of a gaseous fuel, such as oxi-hydrogen, carbon monoxide, various hydrocarbon fractions, or other similar materials to be directed downwardly towards an indirect contact therewith. Means are also included for introducing a pressure gradient, directed from the top to the bottom of the housing so that the combustion gases are downwardly directed over the manifold prior to their exhaust from the housing. This pressure gradient is normally accomplished by introducing a negative pressure below the heat exchange manifold in the housing, but could also be created by applying a positive pressure to the top of the housing above the heat exchange manifold. The burning cycle is conducted intermittently dependent upon the temperature of the working fluid and the means for introducing a pressure gradient in the housing is operational only during such burning cycle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the heat exchange device of the present invention;

FIG. 2 is an exploded perspective view thereof with parts broken away or removed for clarity;

DESCRIPTION OF THE INVENTION

Figure 3:
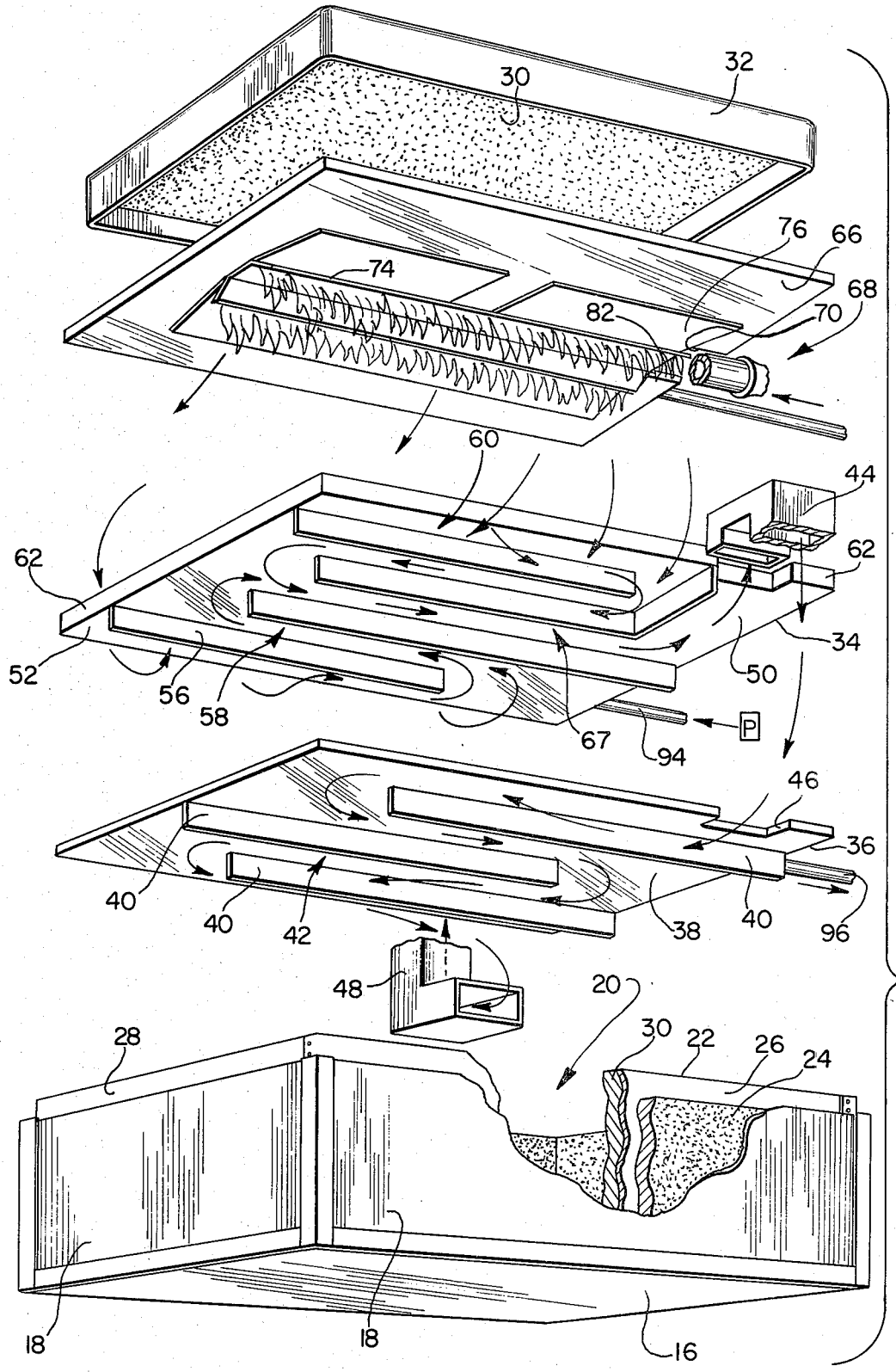
FIG. 3 is an exploded perspective view thereof similar to FIG. 2, but viewed from below the device and wherein an inner box 22 is not fully disposed within the housing 12.

Referring to the drawings and more particularly to FIG. 1, there is shown at 10 a heat exchange device comprising a housing 12 which in turn includes an outer box or enclosure 14. The outer box includes a bottom wall 16 from which sidewalls 18 upwardly extend and terminate in an open top 20 in turn adapted to receive an inner box 22 completely separated therefrom by heat insulation sheets 24.

The inner box includes opposed end walls 26 and sidewalls 28. A layer 30 of insulating refractory material is positioned against the inside surfaces of the end and sidewalls 26, 28 as well as the bottom wall thereof (not shown). The housing further includes a top 32 also provided with insulating refractory 30. The inner box and housing accordingly form an enclosed refractory lined chamber in which the combustion and heat exchange functions of the present device may be carried out.

The device 10 further includes first and second heat exchange manifolds 34, 36. The second heat exchange manifold 36 includes a plate 38 having a plurality of downwardly extending side-to-side orientated spaced baffles 40. The perimetal extent of the plate 38 is such that it snuggly engages the refractory material 30 provided at the side and end walls 26, 28 of the inner box 22 except for a gas transfer inlet 44, provided for transfer of gases to the underside of plate 38 as shall hereinafter be apparent. In addition, the baffles 40 rest on the refractory layer 30 provided on the bottom wall of the inner box 22 so as to space the plate 38 therefrom. The baffles 40 in turn serve to form a single interconnected labyrinth passage 42 such that combustion gases formed from the burning of fuel as will hereinafter be explained, may pass from an inner flue 44 positioned within an inwardly extending notch 46 provided in the plate 38, downwardly past the plate and into the labyrinth passage 42 wherein it serves to heat the underside of the plate 38 and then be removed therefrom by means of an exterior exhaust flue 48.

The first heat exchange manifold 34 is positioned on top of the second heat exchange manifold 36 and includes a plate 50 having end edges 52 and side edges 54. The extent of the end edges 52 is such that they engage the refractory material 30 provided on the end walls 28. The side edges 54 are, however, spaced from the refractory 30 provided on the sidewalls 26 such that and as will hereinafter be more fully explained, combustion gas may pass from the top of the first manifold 34 through the space formed between the side edges 54 and the box 22. The bottom of the plate 50 is provided with a plurality of downwardly extending side-to-side spaced baffles 56 which are adapted to rest on the upper surface of the second manifold plate 38 and thus form a pair of labyrinth passages 58 and 60 which inwardly extend from opposite side edges 54 of the plate 50 towards a common passage 67 to which the interior flue 44 is connected. The plate 50 is provided with structuring on the upper surface to accomplish the desired turbulence. This structuring may be in the form of corrugations which run transverse to the flow direction of the hot gases or short vertical baffles or surface dimpling or any other means which will mechanically cause the gas flow across the surface to depart from liminar flow conditions by the proper amount to achieve maximum heat transfer rate without interfering with combustion efficiency. An upper plate 66 is in turn adpated to rest on the upper peripheral edges of the inner box 22 so as to space such from the surface of the plate 50 and form a combustion chamber 68 therebetween. The cover 32 is adapted to fit over the plate 66 and be spaced therefrom so as to provide at least some space therebetween such that air may enter through the top 32 through openings (not shown) and be drawn into the combusion chambers 68 via such space. The upper plate 66 is in turn provided with an open U-shaped slot 70 into which a burner 72 of elongated configuration and having rows of spaced fuel outlet openings 74, is disposed. Additionally, the underside of the upper plates 66 may be provided with flame deflectors 76. Gaseous fuel is adapted to enter the system by means of a conduit 78, through a venturi 80 and into the burner 72 where it is ignited by an electrical ignitor 82.

In order to draw the air needed for combustion to the gaseous fuel into the combustion chamber 68 and so as to direct the resultant flame and combustion gases formed thereby downwardly with respect to the heat exchange manifolds 34 and 36, a positive draft fan 84 is appropriately supported by the housing 12 and connected by means of a conduit 86 to the outer flue 48. One end of the outer flue 48 in turn communicates with the labrinth passageway 42 such that the gases present therein are upwardly drawn by the action of the fan 84 and discharged therefrom. The other end of the outer flue 48 is pen to the atmosphere as at intake air port 88 i.e., an atmospheric inlet opening, which is in turn adapted to be closed by a balancing damper 90 controlled by weight 92 so as to regulate and accordingly maintain the desired value of negative pressure at the other end of the outer flue 48 and thus in the lower part of the inner box 22. Such causes an overall negative pressure to be present within at least those portions of the inner box 22 positioned below the upper plate 66 such that combustion air may be drawn through the top 32, across the upper plate 66 and thence to the combustion chamber 68. Negative pressure is also used to draw air into the throat of the venturi 80 where it is mixed with the gaseous fuel before being delivered to the combustion chamber 68. Upon combustion, both the resultant flame and combustion gases are directed on to the surfaces of the heat exchange manifold 34 and thence downwardly pass over the first heat exchange manifold 34 through the spaced side edges 54 thereof and into the labyrinth passages 58, 60 and 67 located therebeneath. Thereafter, the combustion gases, as previously indicated, move through a U-shaped bend in the inner flue 44 so as to be drawn beneath the second heat exchange manifold 36 and into the labyrinth passages 42 thereof. Thereafter, the combustion gases are drawn out through the outer flue 48 and to atmosphere by the action of the positive draft fan 84.

Generally, the plates 38 and 50, respectively forming part of the manifolds 36 and 34, are fashioned from an easily formable heat conductive metal such that conduits for the passage of a working fluid such as water may be integrally formed therein. The conduit may also be separate thereof. Accordingly, a conduit 94 is provided on the top surface of the plate 50 of the first heat exchange manifold 34. Such conduit 94 includes an entrance end and an exit end whereby water or other working fluid may be forced through the conduit 94 as by pump P shown schematically in FIG. 3 and the several turns 95 thereof as illustrated. The upper surface of the plate 38 is similarly provided with a second conduit 96 also having entrance and exit ends, the exit end of the conduit 94 being connected to the entrance of conduit 96 by means of appropriate piping (not shown).

The surface of the conduit 94 may be provided with a high temperature resistant coating (not shown) of ceramic-like material such as aluminum oxide and the like such that the flame may be directly passed thereover so as to establish a high temperature gradient between the outside of the conduit and the working fluid contained therein. This assures that heat is quickly transferred to the working fluid in order to avoid the corrosion associated with the condensation of water from the products of combustion. The heat resistant coating may be very thin so as to not materially reduce the normally high heat conductivity of the conduit 94. The coating may also be applied to the top surface of manifold 34 as well. The high temperature resistant coating thus forms the means by which the conduit may be in effect shielded from the normally adverse effects of high temperature and the corrosive combustion gases formed in the combustion chamber. As previously mentioned and although generally not practical except in very special applications due to high costs, such shield means may be accomplished by forming the conduit 94 from such high temperature and corrosion resistant alloys such as Iconel and Hastalloy.

Figure 4:
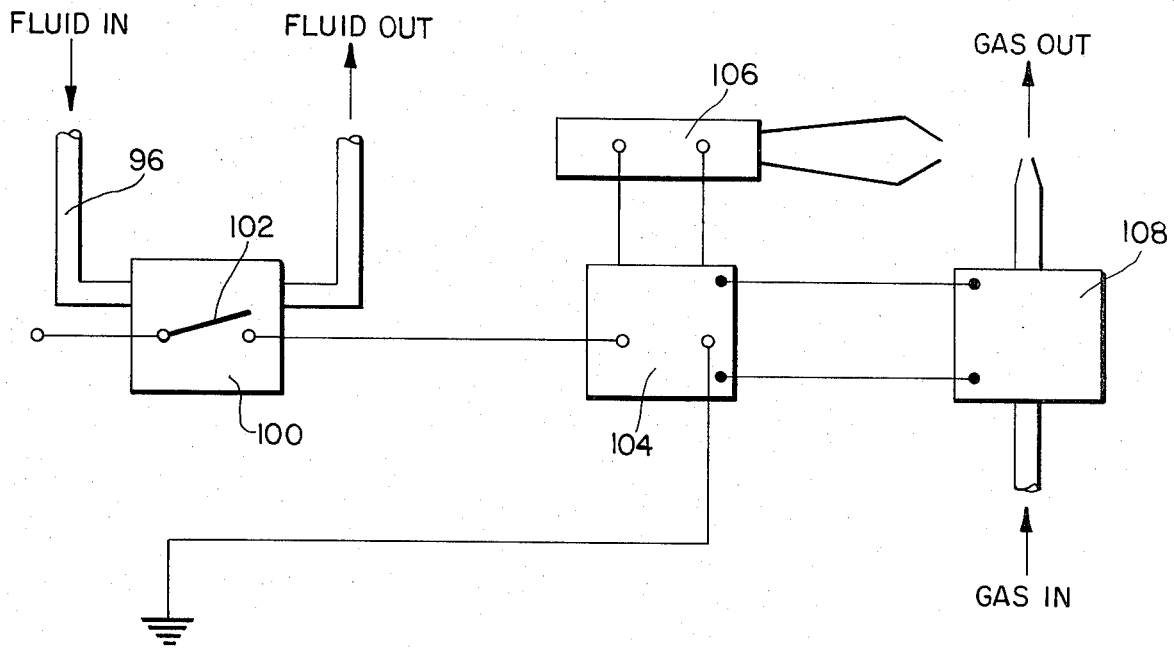
FIG. 4 is a schematic diagram of one form of control circuit that may be used with the present invention.

Generally, the burner 72 is cycled on and off according to the needs of the heat exchange system in which the device 10 is incorporated. Such needs may be signalled by a control 98 including an appropriate operating circuit, positioned at the exit end of the conduit 96 to determine the temperature of the working fluid as it passes out of the device 10. When such temperature drops below a predetermined level, the burner is activated, and when the temperature exceeds another predetermined level, the burner is deactivated. An example of a suitable control circuit is shown in FIG. 4 wherein the fluid exiting from conduit 96 passes through aquastat 100 having a temperature response switch 102 therein which is in circuit with spark generator 104 in turn connected to spark igniter 106 and gas valve 108. When the fluid temperature is above a predetermined point, switch 102 opens to break the circuit, thus deenergizing spark generator 104 and gas valve 108 which in turn shuts off the flame in the boiler. When the fluid temperature falls below the predetermined point, switch 102 closes, whereby power is restored to the spark generator and gas valve to reactivate the flame in the boiler. It should be apparent that during the off cycles, the forced draft system of the device maintained by the fna 84 is not required and accordingly would be inactive. The absence of a continual draft in this device as when the burner 72 is off, contributes to the efficiency of the device since there is no natural gas updraft in the system to continually draw off heat from the various components of the system with which it is in contact as in natural convection draft systems of the prior art. In addition, heat from the combustion gases not absorbed by the flame shield and working fluid is at least in part absorbed by the plates 50 and 38 by the movement of such combustion gases through the labyrinth passage provided on the under surfaces of each such plate. Also, the combustion gases pass directly over the upper surface of the lower plate 38 so as to directly heat its upper surface as well as the exposed surfaces of the conduit 96 which are part thereof or supported thereby.

An effective flow rate of combustion air has been found to be between 120 and 180 percent of the theoretical rate required for stoichiometric combustion; and in those cases where such air is drawn across the upper surface of the upper plates 66 downwardly into the slot 70, such action in effect produces a cooling of the top of the combustion chamber 68 and thus reduces the need for insulation in the top cover 32. It has also been found that maintaining a static pressure drop through the device from the combustion chamber 68 to the exhaust flue 48 of from 1.50 to 3.50 inches w.c. is effective when combined with the above-indicated flow rates of combustion air.

Any suitable materials may be utilized for the construction of the device of the present invention: various grades of steel and related materials have been found useful for the constuction of the housing components while stainless steel alloys have been found desirable in forming the heat exchange manifolds. Any suitable hydrocarbon fuel including natural gas, methane, propane, butane or the like may be utilized as the combustion gas. Also, suitable working fluids include in addition to water: air, oil, brine and other suitable heat exchange fluids.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A high efficiency heat exchange device comprising a housing, a first heat exchange manifold disposed within said housing and forming a lower floor of a combustion chamber disposed directly thereabove, a second heat exchange manifold disposed within said housing and positioned below said first manifold, said manifolds spaced apart from each other by baffles forming first labyrinth passages, said manifolds including conduit means, means causing a fluid working medium to flow through said conduit means so as to heat said medium, means for introducing and burning a hydrocarbon fuel in said combustion chamber and for directing the resultant flame downwardly towards said first heat exchange manifold, means for exhausting the combustion gases of said burning outside of said housing, means for introducing a pressure gradient from top to bottom in said housing whereby said combustion gases are downwardly directed over and under said manifolds prior to their exhaust from said housing.

2. The device of claim 1, said first manifold conduit means including shield means on the outer surface thereof for shielding such from the harmful corrosion effects of direct flame impingement thereon, whereby the hottest part of said flame may directly impinge upon said shield.

3. The device of claims 1 or 2, said housing including a base, said manifolds each including a generally horizontally directed plate, said second heat exchange manifold including baffles downwardly extending from said second manifold plate, said second baffles spacing said second plate from said housing base and forming second labyrinth passages, said conduit means including separate conduits respectively supported by said first and second plates, said conduits being interconnected with each other to form a continuous flow path for said working fluid, said exhaust gases contacting opposite sides of both of said plates prior to being exhausted from said device.

4. The device of claim 3, said pressure gradient caused by the introduction of a negative pressure below said manifolds, said exhaust means including an atmospheric inlet opening, said means for introducing a negative pressure in said housing being a centrifugal fan supported by said housing, the suction end of said fan simultaneously connected to both said exhaust means and said inlet opening, said inlet opening normally at least partially closed by adjustable damper means so as to control the magnitude of said negative pressure.

5. The device of claim 2, said conduit shield means comprising a thin heat resistant layer formed on the outer surfaces of said first manifold conduit.

6. The device of claim 5, said heat resistant layer formed from a ceramic material.

7. A high efficiency heat exchange device comprising a housing, a first heat exchange manifold disposed within said housing and forming a lower floor of a combustion chamber disposed directly thereabove, said manifold adapted to receive a film of fused metal oxide to cover the top surface of said heat exchange manifold, means for introducing and burning a hydrocarbon fuel in said combustion chamber and for directing the resultant flame downwardly towards said heat exchange manifold whereby the hottest part of said flame may directly impinge upon said oxide film, means for exhausting the combustion gases of said burning outside of said housing, means for introducing a pressure gradient from top to bottom in said housing whereby said combustion gases are downwardly directed over said manifold prior to their exhaust from said housing, and means causing a fluid working medium to flow through said heat exchange manifold so as to heat said medium.

8. The device of claim 7, including means for controlling said means for introducing a gradient in said housing such that said pressure gradient is present in said housing only when said fuel is being burned.

9. The device of claim 7, said first heat exchange manifold including a plate generally horizontally disposed within said housing, said plate including a conduit for the passage of said working medium therethrough.

10. The device of claim 9, wherein opposite sides of said plate are spaced from those sides of said housing proximal thereto such that said combustion gases may pass through the spaces formed thereby.

11. The device of claim 7, including a second heat exchange manifold disposed within said housing and positioned below said first manifold, said manifolds spaced apart from each other by baffles forming first labyrinth passages in turn adapted to receive said combustion gases from above said first manifold, and exhaust means operatively associated with said first passages for exhausting said gases from said housing.

12. The device of claim 11, said housing including a base, said manifolds each including a generally horizontally directed plate, said second heat exchange manifold including baffles downwardly extending from said second manifold plate, said second baffles spacing said second plate from said housing base and forming second labyrinth passages, said working fluid medium means including separate interconnected conduits respectively supported by said plates and forming a continuous flow path for said working fluid, said exhaust gases contacting opposite sides of both of said plates prior to being exhausted from said device.

13. The device of claim 7, said exhaust means including an atmospheric inlet opening, said means for introducing a negative pressure in said housing being a centrifugal fan supported by said housing, the suction end of said fan simultaneously connected to both said exhaust means and said inlet opening, said inlet opening normally at least partially closed by adjustable damper means so as to control the magnitude of said pressure gradient.

14. The device of claim 7, said combustion chamber including a top plate downwardly spaced from said housing and atmospheric inlet openigns whereby air may be drawn into said combustion chamber to support said burning, said combustion chamber inlet openings including means for initially directing said air across the upper surface of said combustion chamber top plate so as to cool such.

15. The device of claim 10, said manifold plate including a plurality of side-to-side spaced baffles downwardly extending from the bottom surface of said plates and inwardly spaced from the sides thereof, said baffles forming a plurality of first labyrinth passages wherein combustion gas passing over said first manifold enters said passages from said opposite sides of said first manifold so as to heat the bottom of said first manifold.

16. The device of claim 15, including a second heat exhange manifold having a working fluid conduit positioned at the upper surface thereof, said second manifold disposed within said housing below said first manifold, said first manifold baffles contacting the upper surface of said second manifold so as to form said first labyrinth gas passages between said manifolds.

17. The device of claim 9, said conduit being at least partially formed from said plate and being an integral portion thereof.

18. A high efficiency method of heating a working fluid in a heat exchange device including a housing, a first heat exchange manifold disposed within said housing and forming the lower floor of a combustion chamber disposed directly thereabove, said manifold including conduit means having a flame shield provided thereon and in direct contact therewith, comprising, introducing a hydrocarbon fuel and oxygen into said combustion chamber and igniting the same, directing the resultant flame downwardly against said conduit means with the hottest part of said flame generally directly impinging thereon so as to establish a high temperature gradient between said flame and said conduit means such that the working fluid rapidly absorbs heat from said flame, maintaining a pressure gradient in said housing so that the lower part thereof is at a lower pressure and thereby directing the combustion gas from said burning over said manifold and directing working fluid through said conduit so that heat from said flame is transferred through said conduit means to said working fluid.

19. The method of claim 18, including sensing the temperature of said working fluid and operating said device on an intermittant burning cycle responsive to a temperature of said working fluid below a predetermined level.

20. The method of claim 18, including controlling the flow rate of oxygen to said combustion chamber to between 120% and 180% of the theoretical rate required for stoichiometric combustion of said fuel.

21. The method of claim 20, including maintaining a static pressure drop through the housing between 1.50 and 3.50 inches w.c.

* * * * *